US006051766A

United States Patent [19]

Taylor

[11] Patent Number: 6,051,766

[45] Date of Patent: Apr. 18, 2000

[54] ADJUSTABLE GUITAR NECK

[75] Inventor: Robert D. Taylor, El Cajon, Calif.

[73] Assignee: Taylor-Listug, Inc., El Cajon, Calif.

[21] Appl. No.: 09/321,271

[22] Filed: May 27, 1999

[51] Int. Cl.[7] ..... G10D 3/00

[52] U.S. Cl. ..... 84/293; 84/267; 84/291

[58] Field of Search ..... 84/293, 291, 267, 84/290

[56] References Cited

U.S. PATENT DOCUMENTS

| | | | |
|---|---|---|---|
| 682,712 | 10/1901 | Riley | 411/493 |
| 1,371,760 | 3/1921 | Grover | 84/269 |
| 1,402,876 | 1/1922 | McHugh et al. | 84/293 |
| 1,707,192 | 3/1929 | Overton | 84/267 |
| 1,932,975 | 10/1933 | Kuhrmeyer | 84/293 |
| 2,113,446 | 4/1938 | Gugino | 280/411.1 |
| 3,196,730 | 7/1965 | Daniel | 84/293 |
| 5,886,272 | 3/1999 | Regenberg | 428/593 |

*Primary Examiner*—Robert E. Nappi
*Assistant Examiner*—Shih-yung Hsieh

[57] ABSTRACT

A stringed instrument such as a hollow body guitar has a neck portion that extends under the tail of the fretboard. The body of the instrument has a pair of recesses which mate with respective tail and heel surfaces on the neck portion. Spacers are placed in the recesses in order to adjust the spacing and angle of the neck portion relative to the instrument's body. If the neck and body are connected to each other by bolts, then any misalignment between the neck and body can be cured by removing the bolts, replacing the spacers with spacers of a different thickness and/or wedge shape, and replacing the bolts. Additional structural components can be added to the neck and inside the body of the instrument in order to further enhance its structural integrity.

16 Claims, 4 Drawing Sheets

ADJUSTABLE GUITAR NECK

FIELD OF THE INVENTION

The present invention is directed to a system for adjusting the neck of a stringed instrument, such as a guitar, relative to its body.

BACKGROUND OF THE INVENTION

A guitar typically has two main components, a neck and a body. The musician squeezes the strings of the guitar against frets that are on the neck in order to change intonations of the strings. The design of the neck is therefore an important part of the guitar's performance.

The design of the neck and the way it is connected to an guitar's body has remained basically unchanged for nearly a century. As shown in the prior art of FIG. 1, a guitar has a neck 1 attached to a body 2. The neck 1 is formed with a heel 1*a* that is glued or bolted to the outer surface of the side 2*b* of body 2. When bolted, two bolts running parallel to the length of neck 1 can be used. As an alternative to simply resting against the outer surface of the body's side, a portion of heel 1*a* can be received into a mortice in the body 2. In such a configuration, the heel and mortice can be dovetailed such that the neck cannot move in a forward-backward direction illustrated by double-headed arrow 6.

A fretboard 5 having a flat underside is glued to the flat upper surface of neck 1. The fretboard 5 typically offers twenty frets between a nut 4 at the far end of the neck, and the twentieth fret 9 which is closest to the center of body 2. The fourteenth fret 7 is located at the edge where heel 1*a* meets body 2. The region of the fretboard 5 between the fourteenth fret 7 and the proximal end of the fretboard adjacent the twentieth fret 9 is a "tail" portion 8 which is glued to the front surface 2*a* of body 2. The neck 1 ends before the tail portion 8 and therefore gives it no support.

The fretboard 5 is usually made of a stiff material such as plastic or wood, but it (together with neck 1) inevitably becomes warped or disfigured either at the time of manufacture or over time. When the fretboard 5 is viewed sharply down its length from a location near the head 3 of the guitar, the top edge 5*a* of fretboard 5 may have the shape shown in FIG. 2.

FIG. 2 shows an example of the disfigurement that the fretboard and neck may sustain. Ideally, the fretboard should be perfectly straight between the nut 4 and the twentieth fret 9. Unfortunately, a bowed or scooped region 5*b* often appears between the nut 4 and a hump 5*c* due to the tension of the strings, humidity, and/or some other factor. The location of hump 5*c* is typically at or near the fourteenth fret 7 where the fretboard's tail 8 ceases being supported by the neck and begins being glued to the front surface 2*a* of the body 2. Between the hump 5*c* and the twentieth fret 9 is a drop-off region 5*d* which, in the illustrated case, is the flat tail 8. It remains flat because it is glued to the body 2.

Strings 10 hover over the fretboard 5 and, when the guitar is played, must be squeezed against the frets. However, because of the disfigurement the low spots in the middle of the scooped region 5*b* make the guitar difficult to play, may make the guitar out-of-tune, and if severely warped will cause the strings to contact the hump 5*c*. These unwanted characteristics can only be fixed with a lot of labor. A technician must disassemble the guitar, change the angle of inclination of the neck 1 relative to the body 2, and re-attach the neck to the body. Disassembling the guitar begins by removing the glued tail 8 from the front surface 2*a* of body 2 at the risk of damage to the tail, neck, and/or body. The heel portion 1*a* of the neck must also be detached from the body 2. Next, the proximal surface 1*b* of the heel 1*a* is reworked to give a different angle of inclination to the neck. When the neck is reattached, the hump 5*c* might have been successfully removed thanks to the new angle of inclination, but the scooped region 5*b* will likely remain. In some prior art necks, a truss rod is embedded along the length of the neck and can be adjusted to straighten out the scoop 5*b*.

Another problem in the prior art is the fact that material is removed from the proximal surface 1*b* of heel 1*a*, moving the neck closer to the body and thus changing the intonation of the guitar. Additional labor may then be required to remove and relocate the bridge or saddle 34*c* in order to reinstate the original intonation.

BRIEF SUMMARY OF THE INVENTION

The inventor of the present invention has discovered an effective and inexpensive way to cure the misalignment of a stringed instrument's body and neck without sacrificing sound quality, construction quality, or physical appearance of the instrument. According to certain embodiments of the present invention, misalignment can be cured with only minimal labor using shim sets to adjust the angle of inclination of the guitar's neck relative to its body. Additional aspects of the present invention give greater strength to the neck and/or to the neck-body joint.

It is therefore an object of the present invention to provide a guitar having replaceable shims that align the guitar's neck relative to its body about a pivot point lying on the surface of the fretboard of the neck.

A broader object of the present invention is to provide a stringed instrument with at least two replaceable shim sets that change an angle of inclination of its neck relative to its body, the shim sets lying in different planes relative to one another.

Another object of the present invention is to provide inventive methods for re-aligning the neck and body of a stringed instrument.

A still further object of the present invention is to provide an instrument whose connection between neck and body is very strong and can be hidden from view.

These and other objects are achieved by providing a stringed instrument, comprising a body portion having at least first and second surfaces; a neck portion having at least third and fourth surfaces respectively aligned with said first and second surfaces; at least a first spacer disposed between said first surface and said third surface; and at least a second spacer disposed between said second surface and said fourth surface.

These and other objects are also achieved by providing a method of adjusting a neck and body of a stringed instrument relative to one another, said neck and body being joined together with a plurality of spacers therebetween, said method comprising (a) detaching the body of the instrument from the neck; (b) removing at least one of the spacers and replacing it with a new spacer; and (c) reattaching the body of the instrument to the neck.

Additional objects of the present invention are achieved by providing a jointing structure for connecting a neck portion to a body portion of a stringed instrument, comprising a generally L-shaped piece having first and second legs generally perpendicular to one another; and an elongated finger board brace extending generally transverse to a length of said first leg, said finger board brace being at an end region of said first leg distal from said second leg.

Further scope of applicability of the present invention will become apparent from a review of the detailed description and accompanying drawings. It should be understood that the description and examples, while indicating preferred embodiments of the present invention, are not intended to limit the breadth of the invention since various changes and modifications within the spirit and scope of the invention will become apparent to those skilled in the art.

BRIEF DESCRIPTION OF THE DRAWINGS

The present invention will become more fully understood from the detailed description given below, together with the accompanying drawings which are given by way of illustration only, and thus are not to be construed as limiting the scope of the present invention. In the drawings.

DETAILED DESCRIPTION OF THE PREFERRED EMBODIMENTS

Figure 3:
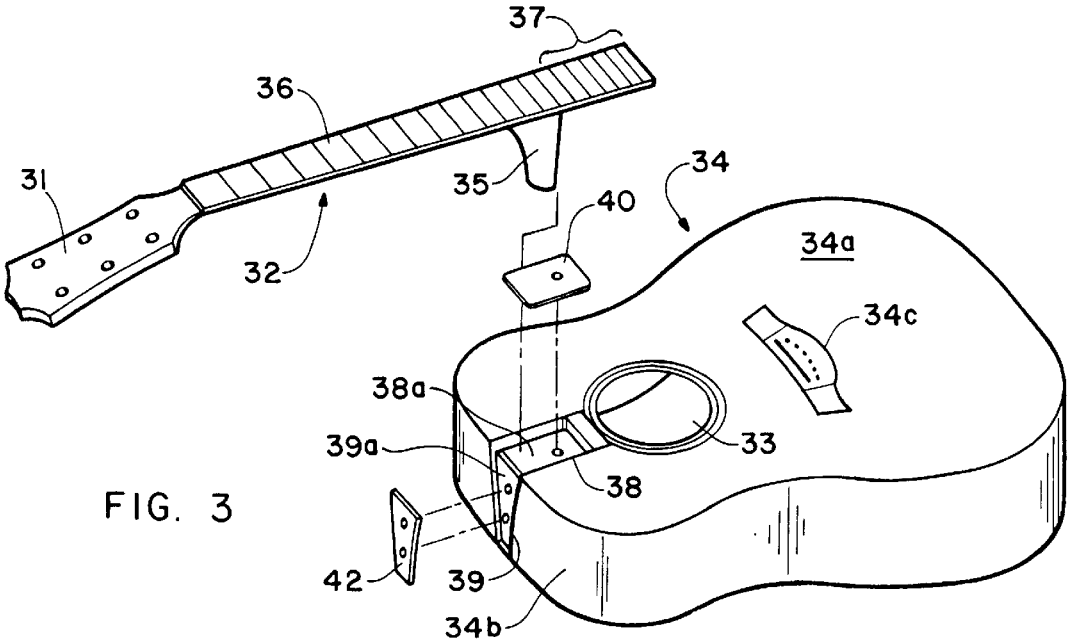
FIG. 3 shows an exploded view of a stringed instrument according to an embodiment of the present invention.

FIG. 3 shows a hollow body guitar 10 according to a preferred embodiment of the present invention. The present invention can be adapted to other stringed instruments, but a hollow body guitar is the preferred embodiment and therefore the description of the various embodiments will be made with reference to such a guitar.

The guitar has a neck portion 32 and a body portion 34. The neck portion 32 includes a neck blank supporting a fretboard 36. The neck blank may be made of a single piece of wood, metal, plastic, or other rigid material, but as described below a preferred embodiment of the neck blank includes two or three pieces of wood. The fretboard 36 can also be made of wood, metal, plastic, or other rigid material but it is best to use a material that can be planed to a smooth flat surface. The artisan will appreciate that the playing surface of the fretboard can be sculpted to any desired shape such as a slightly convex shape as considered in a widthwise direction of the neck. The neck portion 32 also includes a tail 37 and a heel 35 which mate against respective surfaces of the guitar body. A head 31 is optional, as is the heel 35. Decorative scenes or designs can be placed anywhere on the instrument, but it is preferable to construct it out of wood and to coat it with a transparent or tinted finish.

The guitar body 34 is preferably a hollow body with a sound port 33 in the front surface 34*a* of the body. At the front and side surfaces 34*a*, 34*b* where the body portion attaches to the neck portion, the body has a pair of recesses 38, 39. The bottom surfaces 38*a*, 39*a* of the recesses lie generally at right angles relative to one another, and are sized so as to receive respective spacers or shims 40, 42. When the guitar is assembled, spacers 40, 42 are secured between the neck portion 32 and the body portion 34.

According to a preferred embodiment of the present invention, the neck blank used to support the fretboard 36 extends all the way to the proximal end of the neck portion 32 including tail 37. The neck portion 32 is attached to the body portion 34 by a plurality of bolts. In FIG. 3, three bolt holes are shown, two passing from the internal cavity of the body 34 through the bottom surface 39*a* of recess 39 and the spacer 42 into the heel portion 35, and one passing from the internal cavity through the bottom surface 38*a* of recess 38 and spacer 40 into the tail 37. Using this design, no glue is needed to secure the neck and body portions together, and therefore the instrument is very easy to disassemble. More or fewer bolts, and/or other types of attachment mechanisms can be used.

Figure 1:
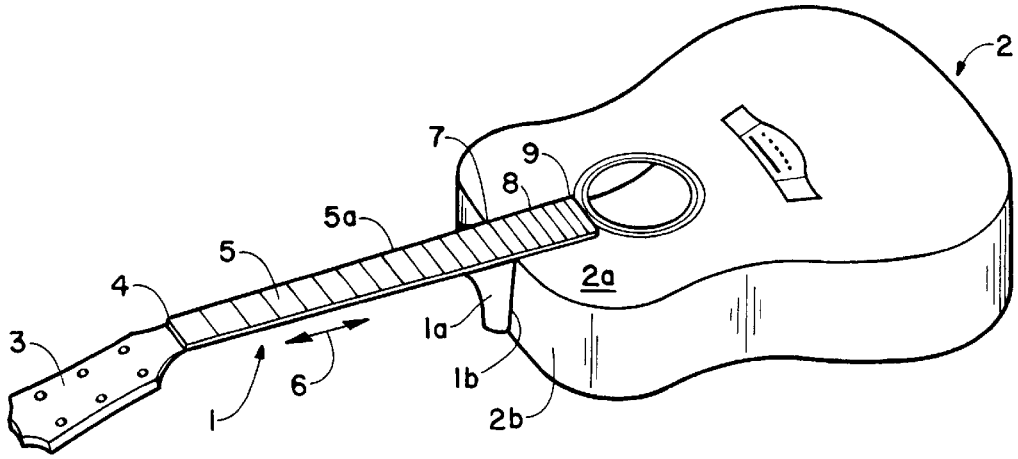
FIG. 1 PRIOR ART
FIG. 1 shows a perspective view of a prior art guitar.
Figure 2:
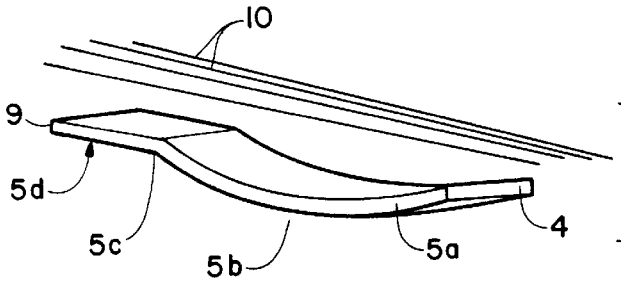
FIG. 2 PRIOR ART
FIG. 2 illustrates a disfigurement that occurs in the neck and fretboard of the prior art.

In the event that the musician wants to raise or lower the angle of the fretboard 36 relative to the body, perhaps because the tension of the strings caused the neck and body portions to "fold up," one need only detach the bolts, replace one or both of the spacers 40, 42 with spacers having a different thickness or a different "wedge" angle, and replace the bolts. Adjustments can thus be made in a matter of minutes, and can be done in a trial-and-error fashion using various spacers. The present invention allows the neck and body to be realigned in multiple degrees of freedom. A thicker or thinner spacer 42 can change the effective length of the neck portion, a thicker or thinner spacer 40 can change the elevation of the fretboard 36, and changes in the wedge angle of either spacer can change the angle of inclination of the fretboard 36 relative to the body without imposing a hump at the fourteenth (or other) fret as was shown at 5*c* in FIG. 2.

The present invention is best implemented by machining the recesses 38, 39, the spacers 40, 42, and the corresponding mating surfaces of neck portion 32 with very high tolerances. The most critical tolerances for spacers 40, 42 are in their thickness and wedge angle. A set can offer a plurality of thicknesses on the order of one to several millimeters thick in fractional increments, and a plurality of wedge angles on the order of zero to only a few degrees (both positive and negative) in fractional (e.g., minute and second) increments. It will be appreciated that the sizes and shapes of the spacers 40, 42 should suit the expected amount of adjustment that may be needed. In one contemplated embodiment, the set of shims offers a consistent thickness of about one tenth of an inch (0.100"), accurate to about two one-thousandths of an inch (±0.002"), and wedge angles in the fractions of a degree, up to about one degree (±1°), so that the "pivot point" of the neck lies on the surface of the fret board at or near the fourteenth fret.

Figure 4:
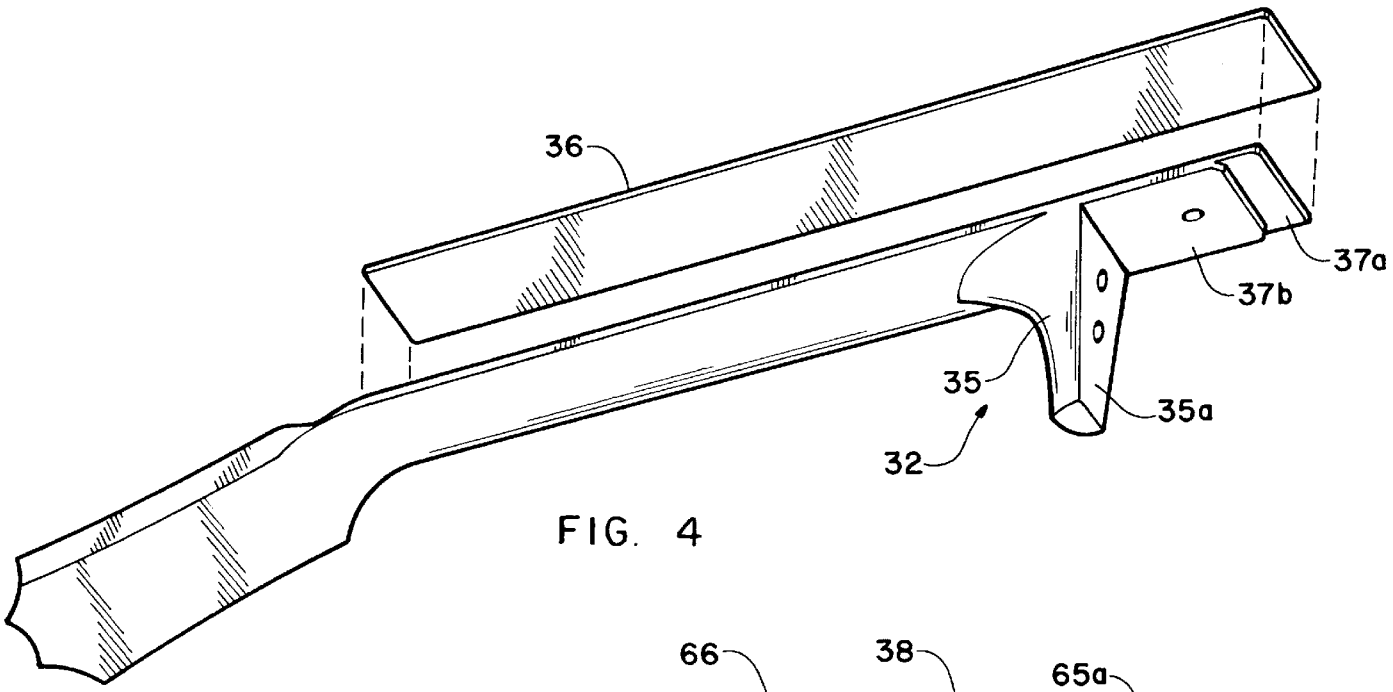
FIG. 4 shows an underside view of a stringed instrument's neck usable in the embodiment of FIG. 3.

In order to preserve the cosmetic appearance of the instrument and to hide the spacers 40, 42, the depth of recesses 38, 39 should be such that the neck portion 32 enters the body portion 34 by a few millimeters or so, even if relatively thick spacers are used. The broad dimensions of the spacers should, but need not be such that they fit snugly in the recesses 38, 39. There is no need to make them friction fit against the sides of the recesses, although such dimensions are certainly not excluded. It is more important for the aesthetics of the assembled guitar for the underside of the neck portion to be machined accurately. FIG. 4 shows detail of the proximal region of neck portion 32 for an embodiment of the present invention. The heel 35 extends generally transverse to the length of the neck, and has a proximal surface 35*a* that is given the same width and height dimensions as the recess 39 so that, when assembled, the recess 39 is not visible and instead the heel 35 appears simply to rest against the side wall 34*b* of the body portion.

Similarly, the tail portion 37 is preferably shaped to hide the presence of recess 38. In FIG. 4, the tail portion 37 of the neck blank is shown having two tiers which generally match the two-tiered recess 38 illustrated in FIG. 3. This multi-tiered embodiment is particularly useful in a hollow body guitar where the fretboard 36 reaches very close to the sound port 33. If the recess 38 were also made to reach very close to the sound port 33, the structural integrity and sound quality of the body might be compromised. This is described in further detail below. In FIG. 4, a first tier 37*a* has the same width and length dimensions of the recess 38 so that, when assembled, the recess 38 is not visible and instead the tail 37 appears simply to rest against the front surface 34*a* of the body portion. A second tier 37*b* is designed to fit into the deeper part of recess 38 and abut the spacer 40. Alternative embodiments will be readily apparent upon reviewing this description. For example, the tail can have a single tier rather than the multi-tiered embodiment of FIG. 4, and/or if the neck blank is made thick enough along its length, the heel 35 might not necessarily protrude discernibly from the neck. In other variations, the second tier 37*b* need not share either the same width nor the same length as the first tier 37*a*. The depth of recess 38 can be such that the fretboard 36, and not the tail portion of the neck blank, appears to rest against the front surface 34*a* of the body. The recesses 38, 39 can be isolated from one another instead of sharing a common edge at the intersection of the body's front and side surfaces 34*a*, 34*b*. Each recess 38, 39 can be separated into a pair, or more, recesses. Other variations are also possible.

Figure 5A:
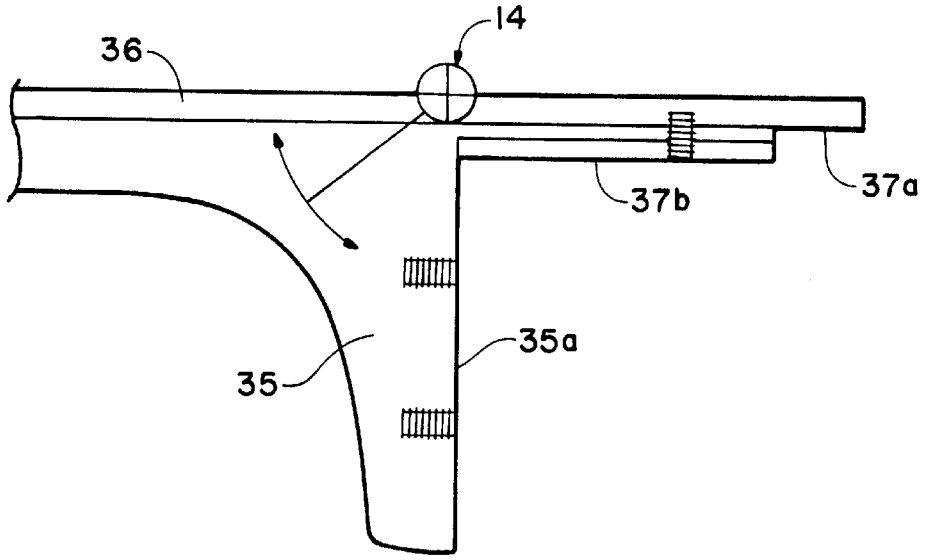
FIGS. 5(*a*) and 5(*b*) show cross-sectional views of a stringed instrument's neck and body joint according to an embodiment of the present invention.
Figure 5B:
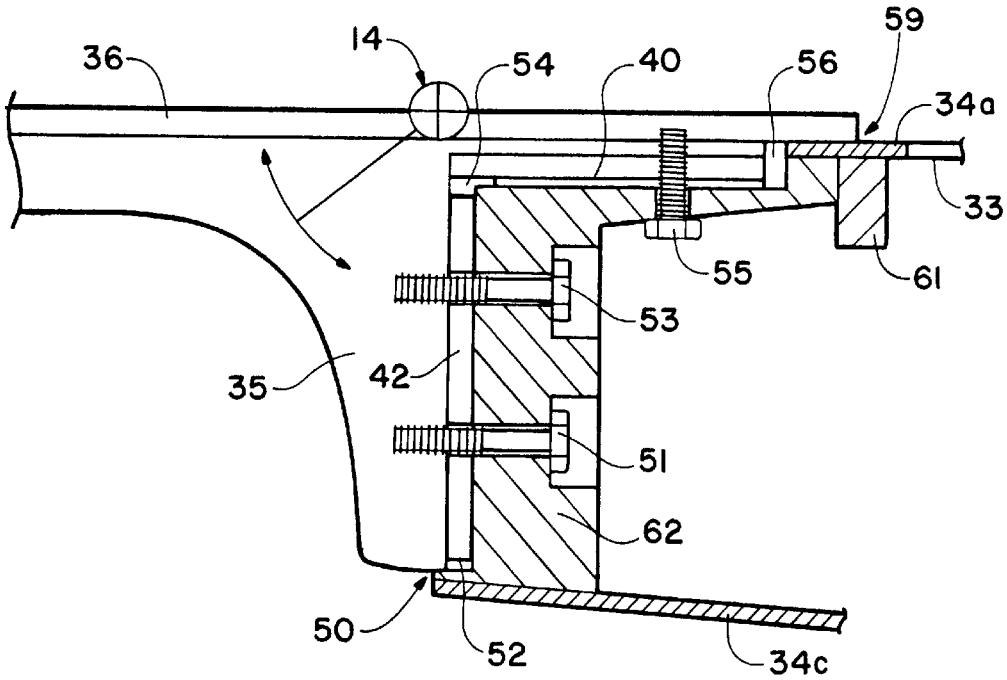

FIGS. 5(*a*) and 5(*b*) provide cross-sectional views of an embodiment of the present invention. FIG. 5(*a*) illustrates the proximal region of the neck portion 32, including the heel 35 and the tail 37. On the fretboard 36, a hinge or pivot fret 14 can be considered the one that lies at or around the mating surfaces 35*a*, 34*a* between the neck and body portions, where the problem of a hump 5*c* can appear. In many hollow body guitars, the pivot fret 14 is the fourteenth fret. With the present invention, a hump 5*c* does not occur because adjustments rotate the entire neck portion, including tail 37, about the pivot fret (or any other point).

FIG. 5(*b*) shows neck and body portions assembled together. Heel 35 is attached to the body by a pair of bolts 51, 53, and tail 37 is attached by a single bolt 55. Spacers 42, 40 are also secured by the bolts, and abut the respective surfaces 35*a*, 37*a* of the heel and tail. Because the spacers need not have a tight fit against the sides of the recesses 38, 39, air gaps 52, 54, 56 may exist within the joint. The length of heel 35 preferably matches the length of recess 39 so that, as shown at arrow 50, an observer thinks that the heel simply rests against the side surface of the body 34. The same is observed at arrow 59 where the fretboard 36 appears to rest against the front surface of the body. At 59, front surface 34*a* of the body can be machined to have the shallow portion of recess 38.

In FIG. 5(*b*) the bolts are shown accessible from inside the hollow body by reaching a person's hand through the sound port 33 with a wrench or other tool. The structure internal to the hollow body which helps join the neck and body portions together can be designed in innumerable ways. However, it is important for the structure to avoid impacting the sound quality of the instrument.

In FIG. 5(*b*), a jointing structure that is mounted inside a hollow body instrument is shown. The jointing structure can be made of any rigid material (or combination of materials) such as wood, plastic, metal, or otherwise. It includes a finger board brace 61 that spans laterally across the internal side of front surface 34*a*, most preferably across the entire width of the instrument in order to furnish the most strength. The brace 61 can be glued and/or tacked in place, and provides structural support to the body portion 34. A second component of the jointing structure is a generally L-shaped piece 62 having respective legs into which the recesses 38, 39 are machined. As with any of the machined surfaces described herein, piece 62 can be hand-tooled or machine-tooled, preferably the latter. L-shaped piece 62 may be glued and/or tacked to the internal side of front surface 34*a*, the internal side of bottom surface 34*c*, and/or to the internal side of side surface 34*b* (not shown in FIG. 5(*b*)). It is also preferably attached, by glue or otherwise, to the finger board brace 61. The L-shaped piece 62 need not span the entire width of the instrument, but together with brace 61 constitutes a strong support for the neck portion.

Figure 6:
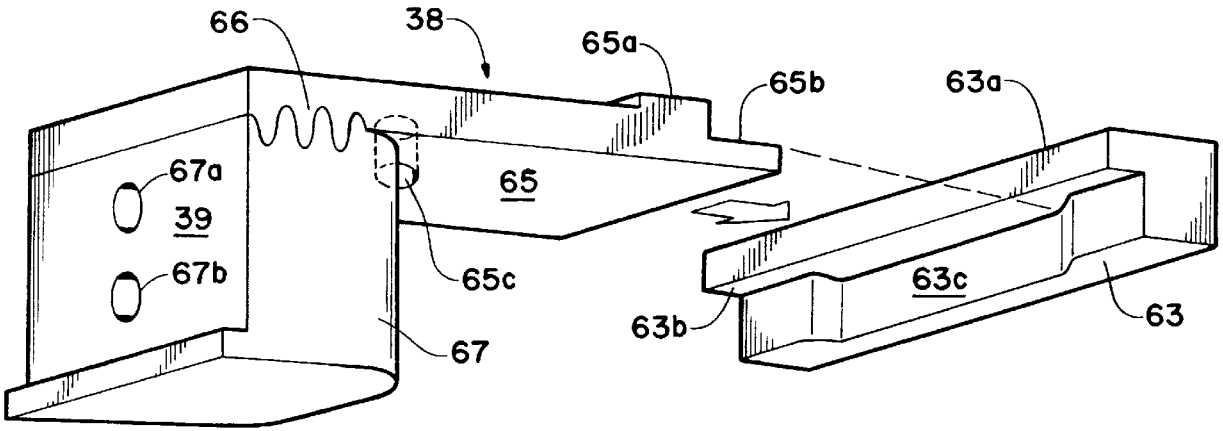
FIG. 6 shows a support structure usable inside a hollow body stringed instrument according to an embodiment of the present invention.

FIG. 6 illustrates another embodiment of the jointing structure according to the present invention, although not necessarily to scale. Like the embodiment of FIG. 5(*b*), the jointing structure can be made of wood, plastic, metal, or other rigid material, and interferes only minimally, if at all, with the tone producing volume of the hollow body. A finger board brace 63 has an upper surface 63*a* which is attached by glue, tacks, or otherwise to the internal side of front surface 34*a*. It has a generally L-shaped cross section, and preferably spans the entire width of the instrument's body 34. A lip 63*b* can, but need not, also span the width of the body 34. At a central region of the lip 63*a*, a depressed area 63*c* gives more surface area to attach lip 63*b* to a shelf 65 of the jointing structure.

Shelf 65 has a lip 65*b* which is secured by glue, tacks, or otherwise to the lip 63*a*, and a surface 65*a* which can be secured to the internal side of front surface 34*a*. Adjacent surface 65*a* is where the recess 38 is preferably machined into the shelf. The shelf 65 can be wider than the recess and therefore surround it on two, three, or four sides, but it is preferable to reduce the amount of material used in order to make the jointing structure light weight. Shelf 65 is preferably provided with a through hole 65*c* which accommodates bolt 55 (FIG. 5(*b*)).

Connected to shelf 65 is a heel block 67. The shelf and heel block can be made from a single piece of material (as can the shelf, the heel block, and the finger board brace), but the illustrated embodiment uses a glued finger joint 66 to attach the shelf 65 and heel block 67 together. The heel block is machined with recess 39, and is provided with through holes 67*a*, 67*b* which accommodate bolts 51, 53. It should be understood that the bolt holes in spacers 40, 42 can be made oval or elongated so that they can be secured regardless of the other spacer's thickness.

Figure 7A:
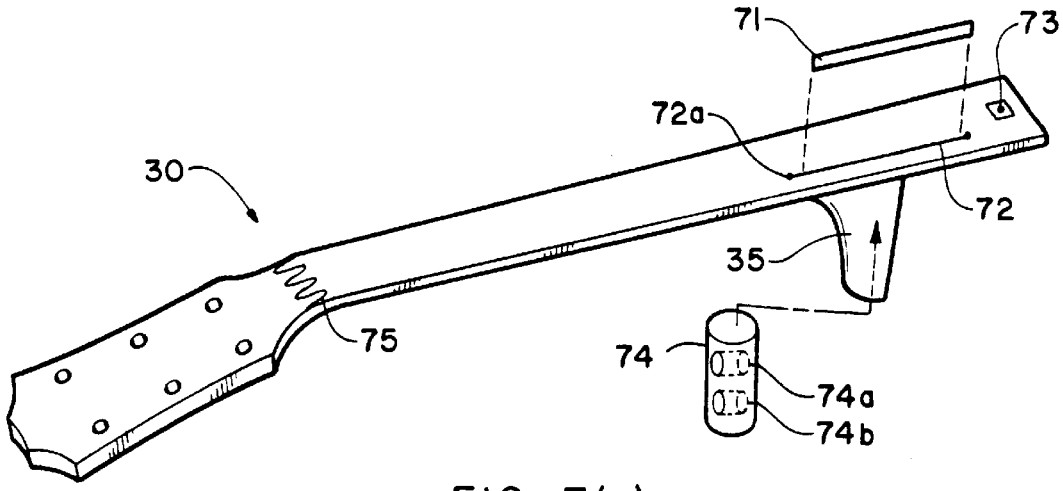
FIGS. 7(*a*), 7(*b*), and 7(*c*) show additional embodiments of a stringed instrument's neck according to the present invention.
Figure 7B:
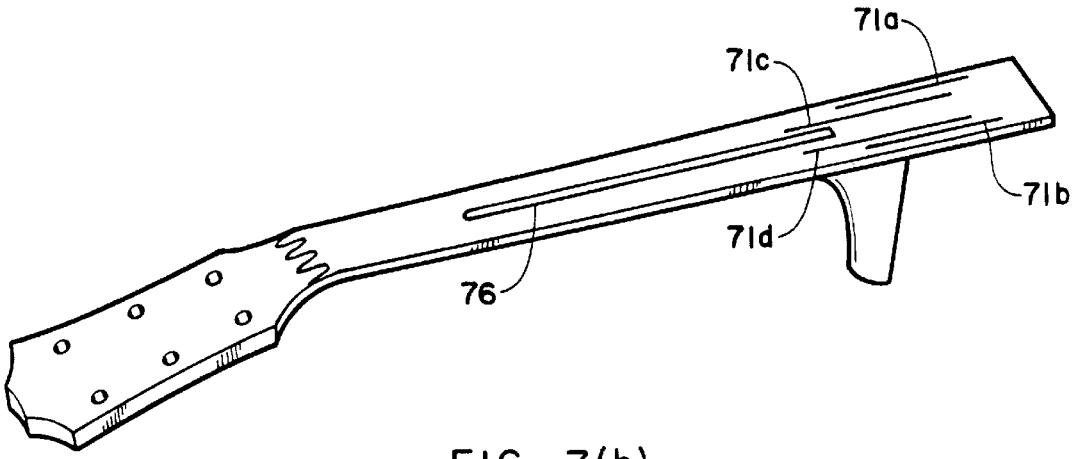
Figure 7C:
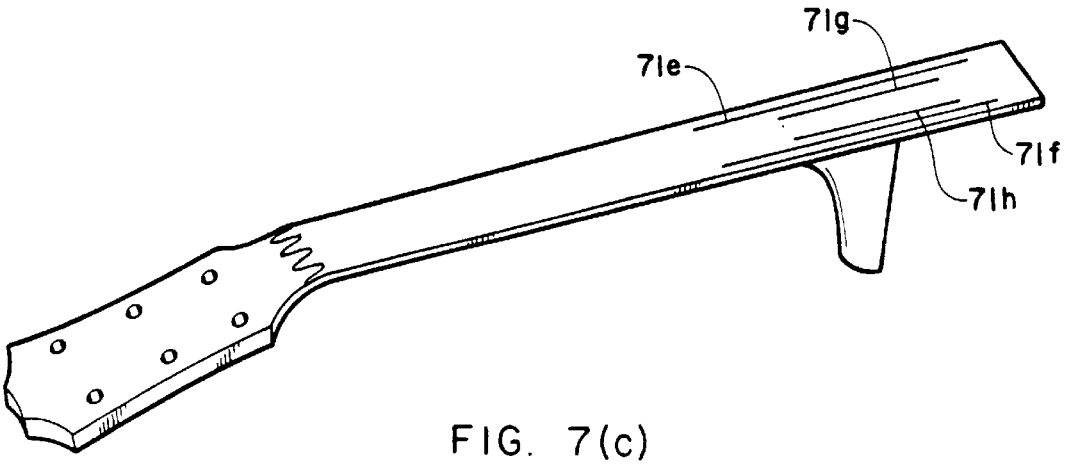

FIGS. 7(*a*), 7(*b*), and 7(*c*) illustrate additional inventive embodiments for use in an instrument's neck. In order to further strengthen the neck portion of the instrument, especially at and around the pivot fret 14, one or more support plates 71 are inserted into corresponding slots 72 machined into the neck blank 30. The plates 71 are preferably hardened steel on the order of 1/16" thick, 3/8 tall, and preferably about 3.5", 4", 6", 7", or 8" long, although any suitable material and size can be used. Before attaching the fretboard 36 to the neck blank 30, elongated slots 72 are made in the blank and glue is placed therein for holding the plate 71. A hole 72*a* can be included in the slot 72 so that excess glue can escape.

FIGS. 7(*b*) and 7(*c*) show different configurations for the plates 71. It is preferable for a group of plates to be used, such as four, with the group approximately centered along its length at the pivot fret 14, and generally equidistantly spaced across the width of the neck. In FIG. 7(*b*), the group includes four plates 71. Two of the plates 71*a*, 71*b* are about 3.5" long and closer to the instrument's body 34 than the other two 71*c*, 71*d*, which are about 7" long. The length of the first pair of plates overlaps with that of the other pair for about 2 to 3 inches. Plates 71*a*, 71*b* are positioned closer to the outward sides of the neck than the other two plates 71*c*, 71*d*. In FIG. 7(*c*), the two outer plates 71*e*, 71*f* are longer, on the order of 10 inches or so, while the other two plates 71*g*, 71*h* are about 6 inches long and lie within the ends of the longer plates.

In FIG. 7(*a*), a metal cylinder 74, such as aluminum, is mounted within a bore in the heel 35. The cylinder is especially useful with the heel is made of wood or other "soft" materials. Cylinder 74 can be inserted from the underside of the heel 35, as shown, or from the fretboard side of the neck blank 30. The latter hides the cylinder from view. Through holes 74*a*, 74*b* are preferably threaded and aligned with the bolt holes for bolts 51, 53 so that the bolts can grip against the metal threads rather than digging into the material of the heel. A metal nut 73 is also preferably mounted into a corresponding recess in the neck blank 30. Nut 73 is aligned with the bolt hole for bolt 55 so that the bolt can grip against the metal threads of the nut rather than digging into the material of the neck blank. It should be noted that nut 73, cylinder 74, and/or truss rod 76 can be used in any of the embodiments shown in FIGS. 7(*a*) through 7(*c*), or with any other embodiment described herein.

It is preferable for the pairs of plates 71 not to end at the same location along the length of the neck. By feathering their ends to different locations along the length of the neck, adjustments made to the truss rod 76 do not result in a kink in the neck, but rather in a smooth, curved transition.

FIGS. 7(*a*) through 7(*c*) also illustrate a glued finger joint 75 connecting a head to the neck blank. In a preferred embodiment, the neck portion of the instrument is manufactured in several stages. The neck begins as a flat piece of mahogany or other material that is shaped into head and the neck segments. The neck segment does not include the heel, which is attached later as a separate piece. The head and neck are joined at the glued finger joint 75, which is a very strong joint. After mounting the plates 71 and/or the cylinder 74 and nut 73, a fretboard is glued to the surface of the neck blank. Instead of using a flat fretboard, the present invention contemplates a truss rod recessed into the neck blank along the length thereof. Filler material used to submerge the truss rod into the neck blank is left high so that it acts as a tenon, mating with a mortise formed into the underside of the fretboard. This mortise and tenon joint of the present invention fixes the fretboard in place and prevents it from moving side to side and/or forward and backward on the neck blank 30. At this point or at a later stage of manufacture, the fretboard is planed using a sanding drum and the frets fixed thereto.

The manufacturing process also includes attaching a heel block onto the underside of the neck blank. The heel block can be secured by glued dowels passing into aligned holes in the neck blank and the heel block. After the heel block is secure, the entire neck portion is milled into its final shape, including cosmetic shaping and the formation of the heel and tail. If the plates 71 are used together with the jointing structure of FIG. 5(*b*) or FIG. 6, the instrument will experience increased strength at the expense of only a few ounces in weight Further, the added weight is in a neutral position between the neck and body.

The invention having been thus described, it will be obvious that the same may be varied in many ways, not only in construction but also in application. For example, each recess can accommodate a plurality of stacked spacers; the spacers can be integrated into a single, approximately 90° piece; and/or the attachment bolts can pass next to, rather than through the spacers. Such variations are not to be regarded as a departure from the spirit and scope of the invention, but rather as modifications intended to be encompassed within the scope of the following claims.

What is claimed is:

1. A stringed instrument, comprising:

a body portion having at least first and second surfaces;

a neck portion having at least third and fourth surfaces respectively aligned with said first and second surfaces;

at least a first spacer disposed between said first surface and said third surface; and at least a second spacer disposed between said second surface and said fourth surface.

2. The stringed instrument of claim 1, wherein said first and second surfaces lie generally at right angles relative to one another.

3. The stringed instrument of claim 1, wherein said body portion includes a front surface, said first surface being in a recess in said front surface.

4. The stringed instrument of claim 3, wherein said neck portion includes a tail, said third surface being on said tail.

5. The stringed instrument of claim 3, wherein said body portion includes a side surface, said second surface being in a recess in said side surface.

6. The stringed instrument of claim 5, wherein said neck portion includes a heel, said fourth surface being on said heel, and further wherein said third and fourth surfaces lie in intersecting planes.

7. The stringed instrument of claim 1, wherein at least one of said spacers includes a through hole, said instrument further comprising at least one bolt passing through said through hole and connecting said neck portion to said body portion.

8. The stringed instrument of claim 1, wherein said first and second spacers lie in intersecting planes and are integrated into a single piece.

9. The stringed instrument of claim 1, wherein said neck portion includes:

a generally planar surface for supporting a fretboard, said planar surface having at least one slot extending along a length of said neck portion and having a depth greater than a width;

at least one elongated plate in said slot;

a truss rod extending in a groove along a length of said neck portion;

filling material for setting said truss rod in said neck portion, said filling material rising above the generally planar surface of said neck and acting as a tenon; and a fretboard having an elongated mortise, said mortise cooperating with said tenon to secure said fretboard in place.

10. The stringed instrument of claim 1, wherein said body portion is hollow and further includes a jointing structure for connecting said neck portion to said body portion, said jointing structure being mounted within said body portion and including:

a generally L-shaped piece having respective legs bearing said first and second surfaces; and an elongated finger board brace extending generally transverse to a length of said neck portion, said finger board brace being at an end region of one of said legs distal from the other one of said legs.

11. The stringed instrument of claim 10, wherein said generally L-shaped piece includes:

a heel block bearing said second surface; and a shelf piece bearing said first surface.

12. The stringed instrument of claim 10, wherein said instrument is a hollow body guitar having front and side walls, said first surface being in a recess in said front wall, said second surface being in a recess in said side wall, and further wherein said neck portion has a tail and a heel, said third surface being on said tail and said fourth surface being on said heel.

13. A method of adjusting a neck and body of a stringed instrument relative to one another, said neck and body being joined together with a plurality of spacers therebetween, said method comprising:

(a) detaching the body of the instrument from the neck;

(b) removing at least one of the spacers and replacing it with a new spacer; and (c) reattaching the body of the instrument to the neck.

14. The method of claim 13, wherein said steps (a) and (c) consist essentially of removing and replacing bolts.

15. The method of claim 13, wherein the new spacer differs from the removed spacer in at least one of: thickness and wedge angle.

16. The method of claim 13, wherein the body includes a front surface with a first recess therein and a side surface with a second recess therein, and the neck includes a tail and a heel, the spacers including at least a first spacer in the first recess abutting the tail and at least a second spacer in the second recess abutting the heel, at least one bolt passing through each of said first and second spacers, and further wherein said step (a) includes removing the bolts that pass through the first and second spacers.

* * * * *